United States Patent [19]

Rosenhauch et al.

[11] 4,372,527

[45] Feb. 8, 1983

[54] BLOWOUT PREVENTER

[75] Inventors: Irwin Rosenhauch, Rockwell; Gary D. Ellis, Richardson, both of Tex.

[73] Assignee: Dresser Industries, Inc., Dallas, Tex.

[21] Appl. No.: 146,576

[22] Filed: May 5, 1980

[51] Int. Cl.[3] ..... E21B 33/06

[52] U.S. Cl. ..... 251/1 A; 137/584

[58] Field of Search ..... 137/559, 315, 584; 166/85; 251/1 R, 1 A, 250; 49/362

[56] References Cited

U.S. PATENT DOCUMENTS

| | | | |
|---|---|---|---|
| 197,838 | 12/1877 | Downey | 137/584 |
| 397,134 | 2/1889 | Matteson | 137/584 |
| 754,801 | 3/1904 | Pomroy | 137/584 |
| 1,591,497 | 7/1926 | Reeves | 49/362 |
| 2,592,197 | 4/1952 | Schweitzer, Jr. | 251/1 A |
| 2,720,393 | 10/1955 | Valentine | 49/362 |
| 3,272,222 | 9/1966 | Allen | 137/315 |
| 3,434,729 | 3/1969 | Shaffer et al. | 137/315 |
| 3,472,270 | 10/1969 | Masheder | 137/315 |
| 3,658,287 | 4/1972 | Lerouax | 251/1 R |

FOREIGN PATENT DOCUMENTS

| | | | |
|---|---|---|---|
| 635418 | 3/1928 | France | 137/584 |

OTHER PUBLICATIONS

Composite Catalog of Oil Field Equipment & Services, vol. 3, 1962–1963, pp. 4547–4556.

*Primary Examiner*—H. Jay Spiegel

*Attorney, Agent, or Firm*—John N. Hazelwood; W. R. Peoples

[57] ABSTRACT

A blowout preventer comprises a housing with a pair of opposed rams carrying sealing blocks for sealing against tubing extending through the housing. Openings in the front side of the housing provide access to the sealing blocks for changing the blocks and a door closes the openings during normal in-service use of the preventer. A door guide permits the door to be slid in either of two opposing edgewise directions for exposing the openings one at a time but keeps the door from being movable substantially in a broadwise direction. Sealing inserts disposed within the openings between the door and the sealing blocks serve to seal against leakage and a rack and pinion mechanism provides the means for sliding the door from a centered position closing both openings to opposite edgewise positions exposing one or the other of the openings.

20 Claims, 4 Drawing Figures

BLOWOUT PREVENTER

TECHNICAL FIELD

This invention relates generally to a blowout preventer such as may be used on an oil or gas well to prevent a blowout. More particularly the present invention relates to a blowout preventer having a side door for access to the interior of the preventer for changing parts.

BACKGROUND ART

As used in the well drilling and servicing industry, a blowout preventer is a device such as may be attached to the casing of a well to seal off the annular space between the casing and tubing disposed within the casing so as to contain and control the flow of liquids or gases under high pressure that may be encountered when drilling or servicing the well. A conventional blowout preventer comprises a housing with hydraulic rams connected to opposite sides thereof for movement toward and away from each other inside of the housing. Carried on the ends of the rams within the housing are sealing blocks suitably sized and shaped to engage and seal against the tubing extending through the housing as well as against an interior wall of the housing. The sealing blocks are connected removably with the rams and may be changed through two openings in one or more sides of the housing to accommodate different sizes of tubing or for reasons of wear. In service use, one or more doors are connected to the housing to close the openings and, in prior blowout preventers, these doors are bolted to the housing.

DISCLOSURE OF THE INVENTION

The present invention aims to provide a blowout preventer which is particularly constructed to enable the sealing blocks to be changed more quickly and easily than in prior preventers such as by eliminating the need for removing door bolts in order to change the sealing blocks. Toward this end, the present invention contemplates the provision of a novel blowout preventer in which the door is secured to the housing against broadwise movement away from the opening but may be slid easily edgewise to a position exposing the opening for changing one of the sealing blocks. More particularly, the invention is characterized by construction of the preventer to include a door guide limiting the direction of travel for the door and a door sliding mechanism adapted for moving the door in opposing edgewise directions.

The invention also resides in the provision of a unique sealing insert which is captivated within the opening by the door to seal against leakage when the preventer is being used and which may be easily pulled from the opening when the door is slid into its open position thereby enabling a sealing block to be changed. Herein, the door is constructed to close both openings in the side of the preventer when in a centered closing position and may be moved in one edgewise direction therefrom to expose one of the openings for changing one of the sealing blocks without exposing the other opening and in the opposite edgewise direction therefrom to expose the other opening. Additional advantage in the exemplary construction of the present preventer is found in the provision of stops acting between the door and the housing to limit movement of the door into its two open positions and in the use of an easily releasable latch for holding the door in its centered position against being moved edgewise inadvertently.

These and other advantages of the present invention will become more apparent from the following detailed description when taken in conjunction with the accompanying drawings.

BEST MODE OF CARRYING OUT THE INVENTION

Figure 1:
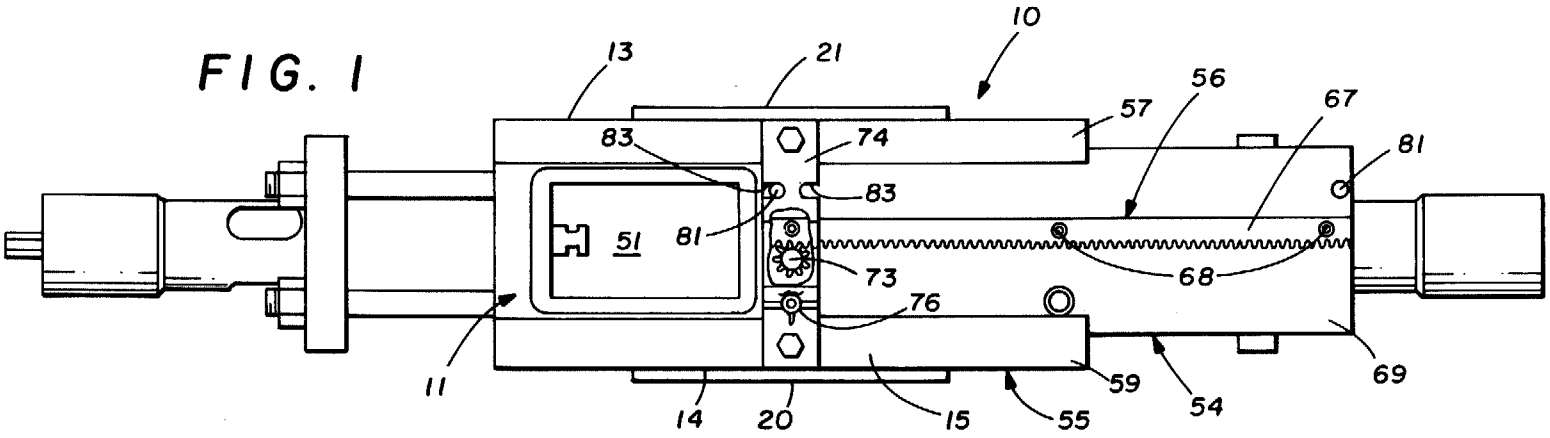
FIG. 1 is a front elevational view of a blowout preventer embodying the novel features of the present invention, but with parts of the preventer in moved positions.

As shown in the drawings for purposes of illustration, the present invention is embodied in a blowout preventer 10 such as is used in the petroleum industry to protect against a blowout in an oil and/or gas well. Herein, the preventer comprises a housing 11 having interconnected top, bottom, front, rear and opposing end sides 13, 14, 15, 16, 17 and 19, respectively. A circular mounting flange 20 on the bottom side 14 may be used to secure the housing to the well casing (not shown) and a similar flange 21 on the top side 13 of the housing is provided for stacking a series of preventers should it be found desirable to employ more than one preventer on a well. Concentric with the flange 20 in the bottom side is a smaller diameter hole 23 (see FIG. 3) and a like hole (not shown) is formed in the top side of the housing aligned vertically with the lower hole for tubing to extend downwardly through the preventer and into the well casing.

Mounted on the opposing end sides 17 and 19 of the housing 11 are hydraulic rams 24 and 25 which include inner end portions 26 and 27 disposed within the housing. Carried on these inner end portions are identical sealing blocks 29 including suitable two-part resilient sealing elements 30 (one part only being shown) for sealing laterally against the tubing and upwardly against the inside surface of the top of the housing around the upper hole. In this way, high pressure fluid is kept from exiting the housing 11 between the sides of the upper hole and the tubing.

Figure 3:
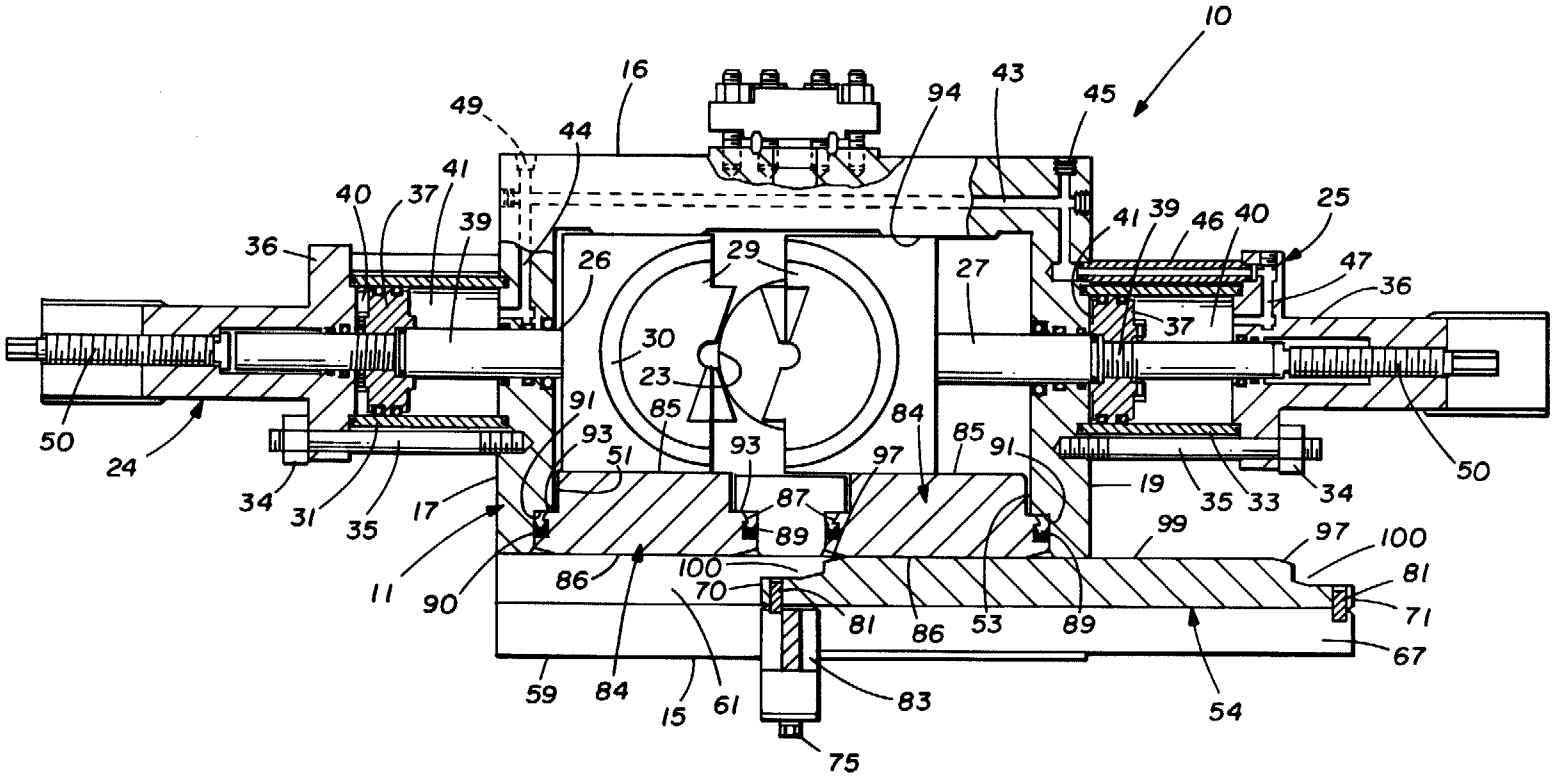
FIG. 3 is a cross-sectional view taken substantially along line 3—3 of FIG. 2.

Movement of the rams 24 and 25 toward and away from each other to cause the sealing blocks 29 to seal against and release the tubing is controlled by pressurizing and venting cylinders 31 and 33 disposed on the opposite sides 17 and 19 of the housing 11. Herein, the operation and construction of the rams 24 and 25 and their associated cylinders are essentially the same to that only one is described in detail hereafter, except as otherwise noted. Accordingly, as shown in FIG. 3, the cylinder 31 is secured to the housing by nuts 34 which are threaded on bolts 35 that, in turn, extend through an end cap 36 and are threaded into the housing. Within the cylinder, a piston 37 is secured to a rod 39 and divides the interior of the cylinder into opposing pressure chambers 40 and 41. Simultaneous pressurization of the outside chamber 40 and venting of the inside chamber 41 causes the piston to shift inwardly, driving the rod and its inner end portion 26 toward the center of the housing for the sealing block 29 to engage and seal against the tubing extending through the housing.

For pressurizing and venting the outside and inside chambers 40 and 41, control passages 43 and 44 within the housing communicate selectively with a pressure source through a suitable control (not shown). Herein, the passage 43 communicates with the control through a port 45 located in the rear side 16 of the housing 11 adjacent the side 19 and is positioned vertically of the passage 44. Connecting tubing 46 (see ram 25) extending from the passage 43 within the side 19 leads to the end cap 36 and a short bore 47 through the cap connects with the cylinder chamber 40 to deliver or vent hydraulic pressure fluid to or from that chamber. The inside chamber passage 44, on the other hand, communicates with the control through a second port 49 in the rear side 16 of the housing. This port, however, is located adjacent the opposite side 17 of the housing. From the port, the passage 44 extends in two directions, one through the sides 16 and 19 to connect with the inside chamber of the ram 25 and another through side 17 of the housing to connect directly with the inside chamber 41 of the ram 24. By simultaneously pressurizing the two outside chambers 40 and venting the two inside chambers 41 of the rams 24 and 25, the two sealing blocks 28 may be moved together to seal against the tubing within the preventer. To retract the sealing blocks, the outside chambers 40 are vented and the inside chambers 41 are pressurized.

As an alternative to moving the rams 24 and 25 hydraulically, screws 50 secured to the end caps 36 may be threaded inwardly into abutting engagement with the outer ends of the rods 39 to mechanically force the sealing blocks 29 toward each other and into engagement with the tubing. It will be appreciated that these screws also may be used to lock the rams in place to keep the sealing blocks from being forced apart in the event of hydraulic pressure failure.

From time to time it may be desirable to change the sealing blocks 29 on the rams 24 and 25 such as for either replacing sealing blocks which have become worn to the extent that they no longer seal properly or for changing to a different size of blocks to accommodate a different size of tubing. Accordingly, the sealing blocks 29 are removably attached to the inner ends 26 and 27 of the rams 24 and 25 and the front side 15 of the housing 11 is provided with two spaced openings 51 and 53 through which the blocks may be removed. When changing the sealing blocks, the block on the ram 24 may be removed through the opening 51 when the inner end 26 of the ram is in its retracted position. Similarly, the block on the ram 25 may be pulled from the housing through opening 53.

During in-service use of the preventer 10, however, a door 54 closes the openings 51 and 53. In accordance with the primary aim of the present invention, the preventer 10 is constructed in a novel manner so as to enable the sealing blocks 29 to be changed quickly and easily and without having to unfasten bolts from the housing 11. For these purposes, the door 54 is secured to the housing against broadwise movement away from the openings 51 and 53 but may be slid edgewise in either of two opposing directions to expose one or the other of the openings for changing the sealing blocks. More particularly, a door guide 55 is secured to the front side 15 of the housing in a plane parallel therewith to direct the door in either of the aforementioned edgewise directions while also holding the door against substantial movement in a direction perpendicular to such plane. Moreover, a rack and pinion mechanism 56 is provided as the means for so sliding the door. By virtue of this construction, the sealing blocks may be changed quickly and easily by simply sliding the door edgewise between closed and open positions, and this may be accomplished without having to loosen, remove, replace and tighten bolts in the housing.

In the present instance, the door guide 55 comprises upper and lower longitudinal flanges 57 and 59 integrally formed with and protruding outwardly from along the upper and lower edges of the front side 15 of the housing 11. Formed within the flanges 57 and 59 are downwardly and upwardly opening grooves 60 and 61 (see FIG. 2) which serve to define channel means receiving the door 54. More particularly, upper and lower edge portions 63 and 64 of the door fit within the grooves so that movement of the door edgewise is guided by the interfitting grooves and edge portions. The latter, however, also serve as shoulder means abutting corresponding shoulders 65 and 66 which define the outward edges of the grooves 60 and 61, respectively and thus captivate the door against movement broadwise away from the openings 51 and 53.

Figure 2:
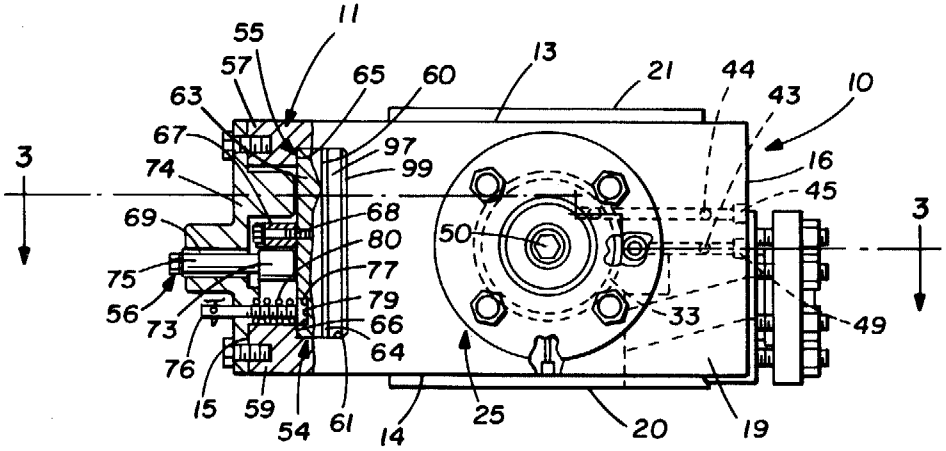
FIG. 2 is an elevational end view of the preventer but showing certain parts thereof in cross-section.

As shown in FIGS. 1 and 2, the door sliding rack and pinion mechanism 56 comprises a rack 67 which is secured by screws 68 to the outside face 69 of the door and extends horizontally between opposite ends 70 and 71 of the door for the full length thereof. A pinion 73 with teeth engaging downwardly facing teeth on the rack is supported by an upright strap 74 secured by screws to the front side 15 of the housing 11 and centered between the two openings 51 and 53. A journaled shaft 75 with an outer hex end connects with the pinion through the strap and may be rotated clockwise or counterclockwise to turn the pinion and thereby move the door edgewise to the right as shown in FIG. 1.

In a centered position, the door 54 closes both openings 51 and 53 and, when in this position, is held against inadvertent movement in either edgewise direction by a latch 76. Herein, the latch is in the form of a pin 76 extending through a hole in the strap 74 directly beneath the pinion shaft 75. Spaced outwardly from an inner end of the pin is an annular flange 77 which abuts the peripheral edge of a recess 79 centered in the door. Between the flange and the inward side of the strap, a spring 80 acts to urge the pin inwardly to seat within the recess 79. Accordingly, as the door is moved into its centered position closing both the openings 51 and 53, the pin snap-fits into the recess locking the door against further edgewise movement. An outward pull on the pin sufficient to unseat the inner end thereof from the recess, conditions the door to be moved from its centered position by turning the pinion shaft 75.

Movement of the door 54 from its centered position in either edgewise direction to expose either of the openings 51 and 53 is limited by means of two stops. The stops each include a projection or lug 81 secured to the door adjacent each end 70 and 71 thereof and protrude outwardly therefrom for abutment with the center strap 74. As shown in FIG. 1, the lugs seat within open-ended slots 83 formed in the strap thereby positioning the end of the door flush with the corresponding edge of the strap. In this way, travel of the door in either edgewise direction is limited to expose the openings 51 and 53 without the rack 67 and pinion 73 disconnecting.

Figure 4:
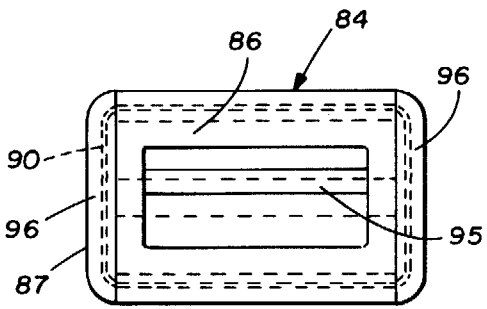
FIG. 4 is an enlarged front view of a part of the preventer.

To assure the existance of a pressure-tight seal across the openings 51 and 53 with the door 54 in its centered position, an insert 84 is telescoped into each of the openings between the door and the sealing blocks 29. The inserts are each of identical construction and comprise a block-shaped member having inward and outward faces 85 and 86 (see FIGS. 3 and 4) and a peripheral edge 87. Seated within a circumferential groove 89 formed in the edge is a high pressure lip seal 90. The latter is adapted to engage sealingly with the sides of the opening 51 once the inserts are seated within the openings. In seating within the openings, an outwardly facing circumferential shoulder 91 in the side of each opening is abutted by an inwardly facing shoulder 93 formed in the edge 87 of each insert. Once seated, the inward faces 85 of the inserts are positioned to co-act with the rearward interior wall 94 of the housing in functioning as guide surfaces for movement of the sealing blocks 29. In the outward face of the insert, horizontal recessed handles 95 are provided for removing the inserts from the openings when changing the sealing block.

As an aid in fitting each of the inserts 84 into its respective opening 51 or 53, opposite vertical edges 96 of the outward face 86 are chamfered and correspondingly chamfered edges 97 are formed in the door within the inward face 99. With this construction, as the door is slid in an edgewise direction across the insert 84 to close the opening 51 for example, the chamfered edge 97 at the end 70 of the door may engage the chamfered edge 96 on the insert and cam the insert slightly inwardly in the event the insert has not been fully seated by hand within the opening.

When sliding the door edgewise to expose the openings 51 or 53 after the interior of the housing 11 may have been exposed to high pressures, another advantageous feature of the present invention provides for breaking the lip seals 90 before completely freeing the inserts 84 for removal. Herein, this is achieved by way of notches 100, one being formed in each end 70 and 71 of the door and opening both inwardly and in an edgewise direction. The notches 100 allow the appropriate insert 84 to be pushed outwardly slightly by any interior pressure to break the lip seal without allowing the insert to be propelled out of the housing as movement of the door exposes the insert. In the event very high pressure exists within the interior of the housing, friction between the inserts 84 and the inward face 99 of the door keeps the latter from being opened easily.

In view of the foregoing, it will be appreciated that the present invention brings to the art a new and improved blowout preventer 10 particularly adapted to enable the sealing blocks 29 to be changed quickly and easily. With the sliding door 54 being slid in one direction edgewise, the opening 51 is exposed for removing one of the inserts 84 and allowing one of the sealing blocks 29 to be changed. Once this sealing block has been changed and the associated insert replaced, the door may be slid in the opposite edgewise direction to expose the other opening 53 for changing the other sealing block 29 in the same manner. Advantageously, with this sliding door construction, the blocks may be changed without having to remove bolts from the housing in order to open the door.

The embodiments of the invention in which an exclusive property or privilege is claimed are defined as follows:

1. In a blowout preventer including a housing with a plurality of interconnected sides defining a hollow interior containing opposed rams with sealing blocks thereon for movement toward each other to seal against tubing extending through the housing, and a door mounted on to said housing and normally closing an opening in one of said sides and through which access is provided to the interior of said housing, the improvement comprising, a door guide connected to said housing and located generally within a plane paralleling said one side, said door being connected with said guide against substantial movement in a direction generally perpendicular to said plane and for movement in a generally edgewise direction away from said opening to expose said opening for changing one of said blocks and a sealing member associated with said opening and acting between said housing and said door when closed to seal against pressure leakage from within said housing.

2. In a blowout preventer including a housing with a plurality of interconnected sides defining a hollow interior containing opposed rams with sealing blocks thereon for movement toward each other to seal against tubing extending through the housing, and a door mounted on to said housing and normally closing an opening in one of said sides and through which access is provided to the interior of said housing, the improvement comprising, the door guide connected to said housing and located generally within a plane paralleling said one side, said door being connected with said guide against substantial movement in a direction generally perpendicular to said plane, door sliding means connected between said housing and said door for moving said door in a generally edgewise direction between a first position covering said opening and a second position exposing said opening to allow access to the interior of said housing and a sealing member associated with said opening and acting between said housing and said door when closed to seal against pressure leakage from within said housing.

3. A blowout preventer as defined by claim 2 wherein said door guide comprises channel means on one of said housing and said door and shoulder means on the other of said housing and said door for interfitting with said channel means to allow said door to be moved in said edgewise direction and to prevent substantial movement of said door in said generally perpendicular direction.

4. A blowout preventer as defined by claim 3 wherein said shoulder means comprises opposite parallel edge portions of said door and said channel means comprising a first flange connected with said housing along one edge of said one side of said housing and projecting outwardly thereof, a second flange connected with said housing along the opposite edge of said one side of said housing and a groove formed in each of said flanges opening toward the other flange, said grooves slidably receiving said parallel edge portions of said door.

5. A blowout preventer as defined by claim 3 wherein said door sliding means comprises a rack and pinion connected between said housing and said door.

6. A blowout preventer as defined by claim 5 wherein said rack is secured to said door and said pinion is journalled on said housing.

7. A blowout preventer as defined by claim 3 or 5 including a latch connectable between said door and said housing for releasably holding said door in a position closing said opening.

8. A blowout preventer as defined by claim 7 wherein said latch comprises a recess in said door and a pin mounted on said housing and spring-urged toward said door to seat within said recess to hold said door in its closing position when seated within said recess.

9. A blowout preventer as defined by claim 3 wherein said rams are mounted for movement in a direction generally parallel to said one side, and said sealing member comprises an insert telescoped into said opening and normally captivated therein by said door, said insert having an inner guide surface engageable by one of said rams when said insert is captivated in said opening by said door.

10. In a blowout preventer including a housing with a plurality of interconnected sides defining a hollow interior containing opposed rams with sealing blocks thereon for movement toward each other to seal against tubing extending through the housing, and a door mounted on to said housing and normally closing an opening in one of said sides and through which access is provided to the interior of said housing, the improvement comprising, a door guide connected to said housing and located generally within a plane paralleling said one side, said door being connected with said guide against substantial movement in a direction generally perpendicular to said plane, and door sliding means connected between said housing and said door for moving said door in a generally edgewise direction between a first position covering said opening and a second position exposing said opening to allow access to the interior of said housing, said door guide comprising channel means on one of said housing and said door and shoulder means on the other of said housing and said door for interfitting with said channel means to allow said door to be moved in said edgewise direction and to prevent substantial movement of said door in said generally perpendicular direction, said rams being mounted for movement in a direction generally parallel to said one side, an insert telescoped into said opening and normally captivated therein by said door, said insert having an inner guide surface engageable by one of said rams when said insert is captivated in said opening by said door, and abutting shoulders formed on said insert and said housing to limit movement of said insert inwardly of said housing, and a peripheral pressure seal between said insert and said opening.

11. In a blowout preventer including a housing with a plurality of interconnected sides defining a hollow interior containing opposed rams with sealing blocks thereon for movement toward each other to seal against tubing extending through the housing, and a door mounted on to said housing and normally closing an opening in one of said sides and through which access is provided to the interior of said housing, the improvement comprising, a door guide connected to said housing and located generally within a plane paralleling said one side, said door being connected with said guide against substantial movement in a direction generally perpendicular to said plane, and door sliding means connected between said housing and said door for moving said door in a generally edgewise direction between a first position covering said opening and a second position exposing said opening to allow access to the interior of said housing, said door guide comprising channel means on one of said housing and said door and shoulder means on the other of said housing and said door for interfitting with said channel means to allow said door to be moved in said edgewise direction and to prevent substantial movement of said door in said generally perpendicular direction, said rams being mounted for movement in a direction generally parallel to said one side, an insert telescoped into said opening and normally captivated therein by said door, said insert having an inner guide surface engageable by one of said rams when said insert is captivated in said opening by said door, and first and second of said openings formed in said one side of said housing, said door normally closing both of said openings in a centered position on said housing and being movable in a first edgewise direction to a first open position exposing said first opening while said second opening remains closed by said door and being movable in a second edgewise direction opposite to said first edgewise direction to a second open position exposing said second of openings while said first of said openings remains closed by said door.

12. A blowout preventer as defined by claim 11 including first and second stops on one of said door and said housing for limiting edgewise movement of said door to said first and second open positions, respectively.

13. A blowout preventer as defined by claim 12 wherein said first and second stops include first and second projections connected to said door and protruding outwardly therefrom for abutting engagement with said housing.

14. A blowout preventer as defined by claim 11 wherein said insert includes an outer face with chamfered edges formed thereon at opposite ends thereof and extending in a direction generally perpendicular to said edgewise directions; said door having an inner face and including matching chamfered edges thereon for camming against said chamfered edges on said insert.

15. A blowout preventer as defined by claim 14 wherein said insert includes a handle connected to said outer face thereof.

16. A blowout preventer as defined by claim 14 wherein said door includes an inner face with opposite ends facing said edgewise directions, a notch formed in said inner face along side each of said opposite ends and opening both inwardly and in said edgewise directions, and having closed sides spaced toward each other from said opposite ends of said door, said chamfered edges being formed in said inner face along said closed sides.

17. A blowout preventer for use in an oil or gas well to seal between a well casing and tubing extending through the preventer and into the casing, said preventer comprising, a housing having interconnected top, bottom, front, rear and opposing end sides, said top and bottom sides each having a hole therethrough for admitting the tubing through said housing, said bottom side being adapted to connect sealingly with the casing, a first hydraulic ram apparatus mounted on one of said opposing end sides, a second hydraulic ram apparatus mounted on the other of said opposing sides, said apparatuses each having an inner end portion disposed within said housing and being operative to move said inner end portion between retracted and extended positions within said housing, a sealing block carried on each of said inner end portions, each said sealing block abutting said tubing in said extended position and cooperating with each other, the tubing and the interior of said housing to seal against leakage out of said housing through the hole in said top side, a pair of openings in said front side with one of said openings to provide access to one of said sealing blocks, a door mounted on said housing, a sealing member associated with each of said openings and acting between said housing and said door to seal against pressure leakage from within said housing, a door guide connected to and extending along said front side, said door being supported on said housing by said door guide for movement selectively in a first edgewise direction from a first position closing both of said openings to a second position exposing said one opening or in a second edgewise direction from said first position to a third position exposing said other of said openings, and mechanism connected between said door and said housing for sliding said door along said guide in said first and second edgewise directions.

18. A blowout preventer as defined by claim 17 wherein said door guide comprises channel means formed in one of said housing and said door and shoulder means formed in the other of said housing and said door for interfitting with said channel means to allow said door to be moved in said edgewise directions and to prevent substantial movement of said door in a direction generally perpendicular thereto.

19. A blowout preventer as defined by claim 18 wherein said mechanism comprises a rack and pinion connected between said housing and said door.

20. A blow out preventer for use in an oil or gas well to seal between a well casing and tubing extending through the preventer and into the casing, said preventer comprising, a housing having interconnected top, bottom, front, rear and opposing end sides, said top and bottom sides each having a hole therethrough for admitting the tubing through said housing, said bottom side being adapted to connect sealingly with the casing, a first ram mounted on one of said opposing end sides, a second ram mounted on the other of said opposing sides, said rams each having an inner end portion disposed within said housing and being operative to move said inner end portion between retracted and extended positions within said housing, a sealing block carried on each of said inner end portions, each said sealing block abutting said tubing in said extended position and cooperating with each other, the tubing and the interior of said housing to seal against leakage out of said housing through the hole in said top side, a pair of openings in said front side with one of said openings to provide access to one of said sealing blocks, a door mounted on said housing, a door guide connected to and extending along said front side, said door being supported on said housing by said door guide for movement selectively in a first edgewise direction from a first position closing both of said openings to a second position exposing said one opening or in a second edgewise direction from said first position to a third position exposing said other of said openings, a sealing insert telescoped into each of said openings and normally captivated therein by said door to seal against leakage out of said housing through said openings, and mechanism connected between said door and said housing for sliding said door along said guide in said first and second edgewise directions.

* * * * *